US007246994B2

(12) United States Patent
Lewis

(10) Patent No.: US 7,246,994 B2
(45) Date of Patent: Jul. 24, 2007

(54) SPACING ARRANGEMENT

(75) Inventor: Leo V Lewis, Kenilworth (GB)

(73) Assignee: Rolls-Royce plc, London (GB)

( * ) Notice: Subject to any disclaimer, the term of this patent is extended or adjusted under 35 U.S.C. 154(b) by 322 days.

(21) Appl. No.: 11/106,621

(22) Filed: Apr. 15, 2005

(65) Prior Publication Data

US 2005/0265825 A1 Dec. 1, 2005

(30) Foreign Application Priority Data

May 27, 2004 (GB) ..... 0411850.1

(51) Int. Cl.
*F03B 3/14* (2006.01)

(52) U.S. Cl. ..... 415/131; 415/174.1; 415/173.2

(58) Field of Classification Search ..... 415/173.1, 415/173.2, 173.5, 174.1, 132, 129; 416/210 R, 416/210 A See application file for complete search history.

(56) References Cited

U.S. PATENT DOCUMENTS 6,607,350 B2 * 8/2003 Dodd ..... 415/14
6,676,372 B2 * 1/2004 Scholz et al. ..... 415/173.2
2002/0150469 A1 10/2002 Bolms

FOREIGN PATENT DOCUMENTS

| | | | |
|---|---|---|---|
| GB | 2 129 880 A | | 5/1984 |
| GB | 2 371 093 A | | 7/2002 |
| JP | 57195803 A | * | 12/1982 |
| WO | WO 99/28598 | | 6/1999 |

* cited by examiner

*Primary Examiner*—Edward K. Look
*Assistant Examiner*—Dwayne White
(74) *Attorney, Agent, or Firm*—Oliff & Berridge, PLC

(57) ABSTRACT

A spacing arrangement for a gas turbine engine 10. The spacing arrangement being arranged such that as a rotor blade 26 of a compressor 13 rotates, the rotor disc 28 will move outwards and forwards to maintain a substantially constant gap 36 between the rotor blade 26 and an inclined casing 20.

19 Claims, 9 Drawing Sheets

SPACING ARRANGEMENT

This invention concerns a spacing arrangement for a gas turbine engine, a compressor for a gas turbine engine, a turbine for a gas turbine engine and also a gas turbine engine incorporating such a spacing arrangement.

In gas turbine engines thermal and centrifugal effects cause the diameter of compressor rotor assemblies to change across the operating range of an engine. This in turn alters the clearance between the blade tips and the casing. Existing methods for trying to control the tip clearance have tended to be mechanically complex and/or detrimental to engine efficiency. Many gas turbine engines including aero applications are required to run at a range of rotational spool speeds, and to maintain adequate efficiency, surge margin and flow at all speeds within their operating range.

The centrifugal growth of the rotor produces an increasing closure with rotational speed, and thus an inherent requirement for build clearances to be significantly larger than the running clearance at high power. This means that the running clearances would remain large through start-up, at low and mid power, and also at cruise.

According to the present invention there is provided a spacing arrangement for a gas turbine engine, the arrangement comprising a first rotatable member and a second non rotatable member with a gap defined between facing surfaces respectively on the first and second members, the gap being inclined relative to the rotational axis of the first member; axial movement means being provided which automatically cause relative movement of a one of the first and second members in a direction to tend to increase the gap between the facing surfaces, in response to the rotational speed of the first member.

The axial movement means may be arranged such that centrifugal forces caused by rotation of the first member cause the axial movement.

The axial movement means may be in the form of a connecting member which connects the first member to a source of rotational movement. The connecting member may pivot and/or flex upon rotational movement to cause the axial movement.

A plurality of first members may be connected to the connecting member.

Where there is a falling hade angle, the connecting member preferably extends from the source of rotational movement, in part in a rearwards direction.

Where there is a rising hade angle, the connecting member preferably extends from the source of rotational movement, in part in a forwards direction.

The gap is preferably inclined at an angle of between 3 and 30° relative to the rotational axis of the first member.

The first member may flex during rotational movement to cause some or all of the axial movement.

The arrangement may be arranged to provide a substantially constant gap width at all rotational speeds.

In a first embodiment the first member may be a compressor blade, with the second member a compressor casing.

The invention also provides a compressor for a gas turbine engine, the compressor comprising one or more spacing arrangements according to any of the preceding eight paragraphs, provided between the compressor blades and the compressor casing.

In a second embodiment, the first member is a turbine blade and the second member a turbine casing.

The invention also provides a turbine incorporating a spacing arrangement according to the invention.

In a third embodiment the second member comprises a stator of a compressor or a turbine of a gas turbine engine, with the first member being part of the rotor.

In a fourth embodiment the spacing arrangement is in the form of a labyrinth seal.

A one of the facing surfaces may be profiled, and the facing surfaces may have complimentary profiles. A one of the facing surfaces may include a plurality of projections. A one of the facing surfaces may have a saw tooth profile.

Embodiments of the present invention will now be described by way of example only, and with reference to the accompanying drawings, in which.

Figure 1:
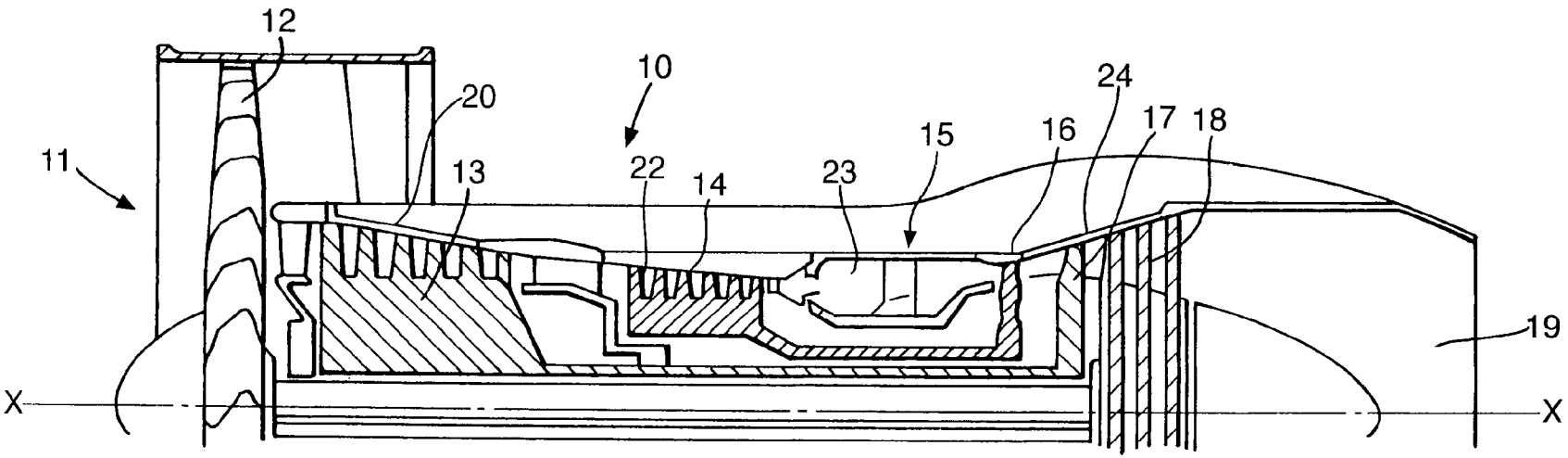
FIG. 1 is a diagrammatic cross sectional view through half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

As can be seen the casings 20, 22 for the intermediate and high pressure compressors 13, 14 converge away from the fan 12, and hence there is a falling hade angle. The casing 24 for the three turbines 16, 17, 18 converges towards the fan 12, and hence there is a rising hade angle.

Figure 2:
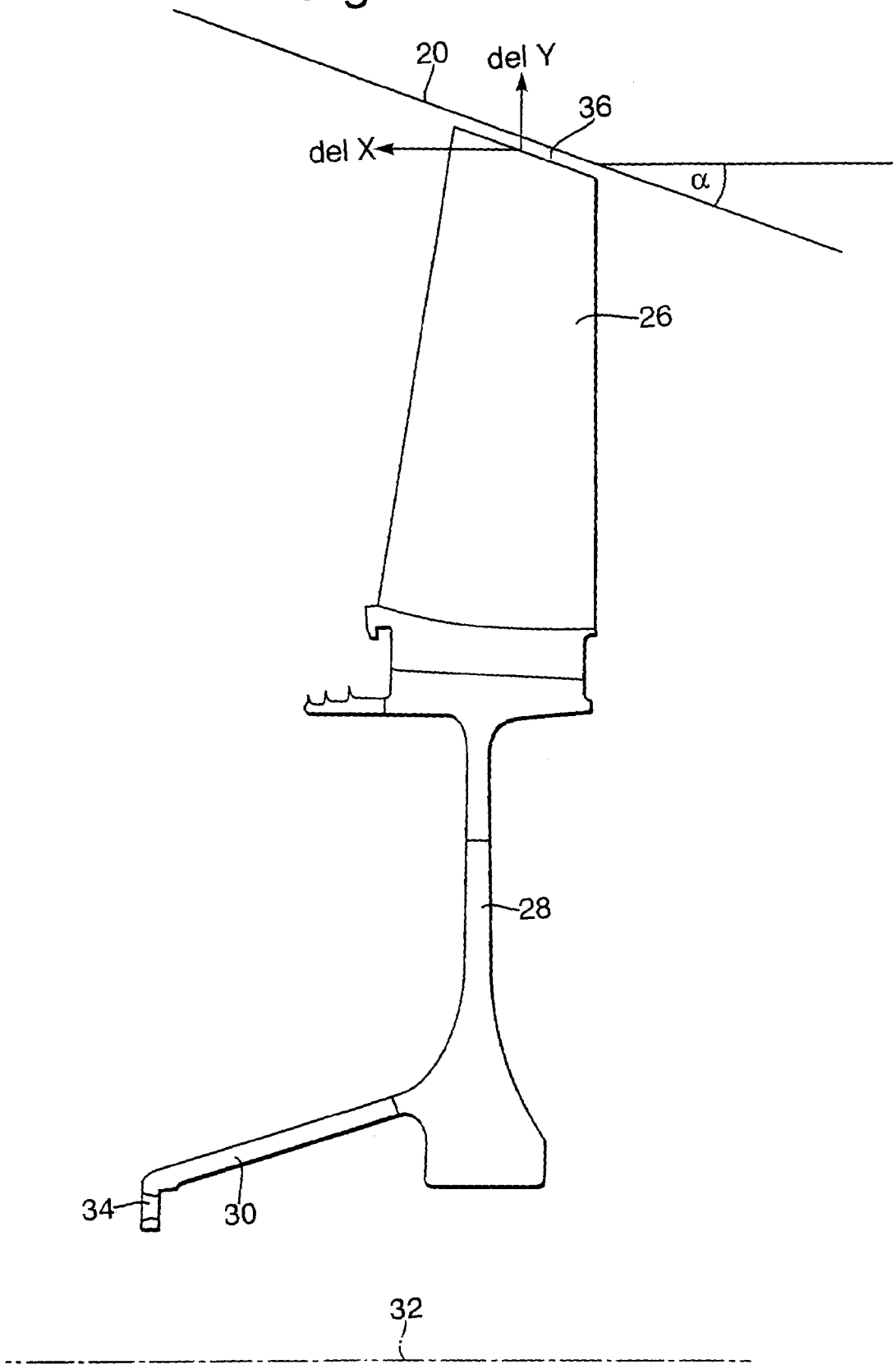
FIG. 2 is a diagrammatic side view through part of a first compressor according to the present invention.

FIG. 2 shows part of the intermediate pressure compressor 13. A rotor blade 26 is shown mounted on a rotor disc 28 connected to a drive arm 30. The casing 20 can be seen inclined at an angle α to the engine centreline 32.

The drive arm 30 is arranged such that in use, during rotation the rotor disc 28 will move outwards and also forwards due to the moment produced by the centrifugal loads acting at the axial rearward offset 34 of the disc 28. This arrangement is intended to maintain the gap 36 between the rotor arm 26 and the casing 20 at a substantially constant amount. To maintain this constant amount the amount of upward movements delY as shown and the forward movements as shown by delX, should make the following equation:

$$delX.\ \sin(\alpha)=delY.\ \cos(\alpha)$$

Figure 3:
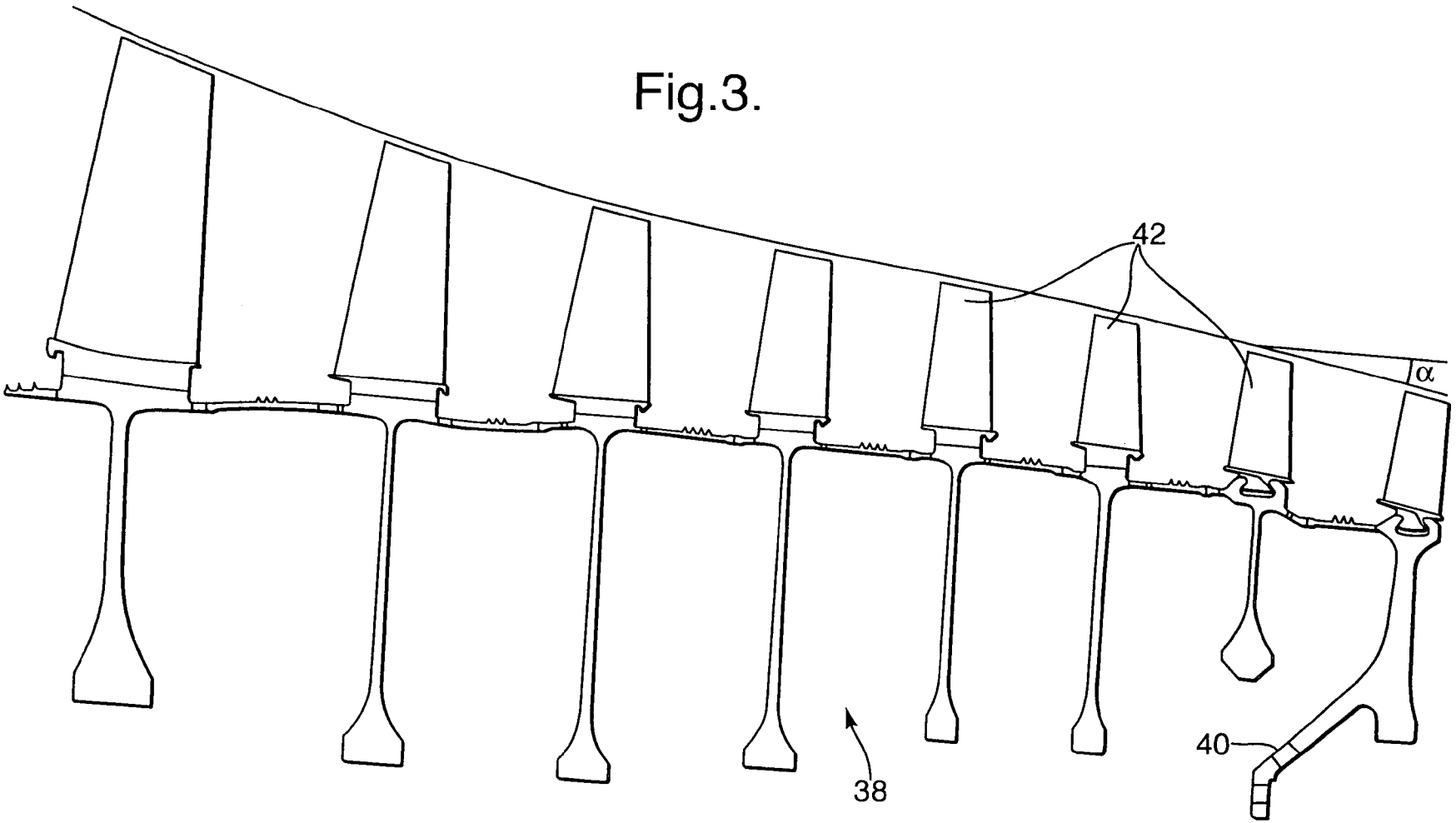
FIG. 3 is a diagrammatic side view through a second compressor according to the invention.

FIG. 3 shows the principle of FIG. 2 being applied to a multistage compressor drum 38 mounted to a single drive arm 40. The drum 38 mounts a plurality of rotor blades 42.

Figure 4:
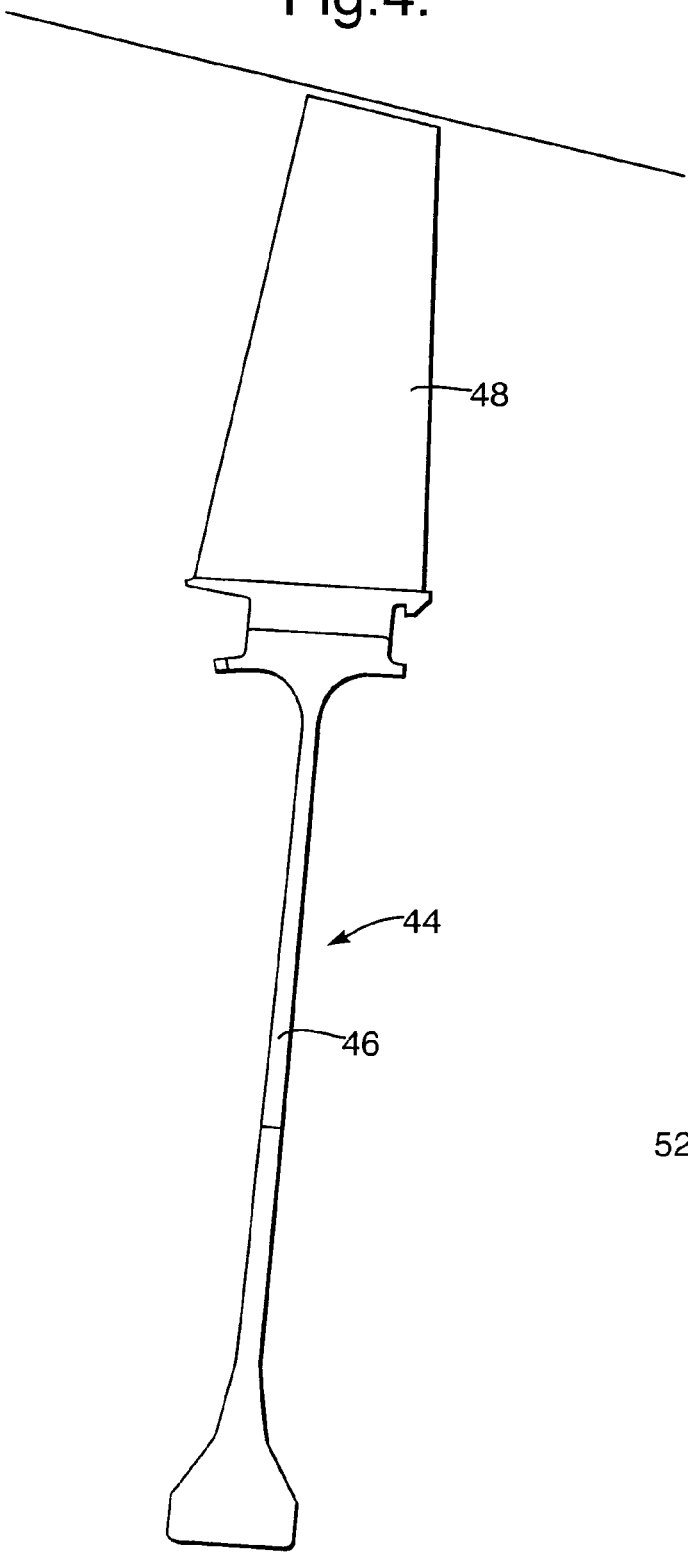
FIG. 4 is a similar view to FIG. 2 of part of a third compressor according to the invention.

FIG. 4 shows a further single compressor stage 44 comprising a rotor 46 and a blade 48. In this instance changes of profile during rotation of the rotor blade 48 itself produces the forward axial movement. This requires the stacking of the aerofoil cross sections to be chosen first to produce the requisite axial movement at the blade tip. Again as much as possible it is desired to satisfy the equation:

$$delX.\ \sin(\alpha)=delY.\ \cos(\alpha)$$

Figure 4A:
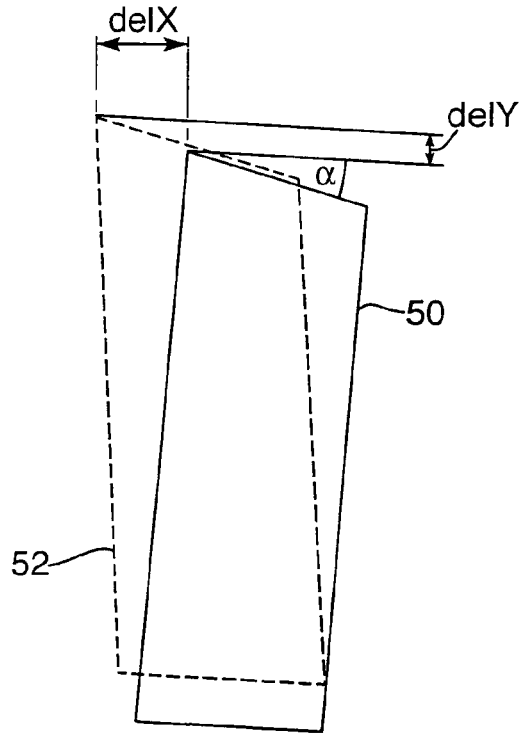
FIG. 4*a* is a detailed view of part of FIG. 4.

DelX is produced by the blade 48 alone, whilst delY is produced by the rotor tip and also the disc 46. Respective positions 50 and 52 are shown in FIG. 4*a* with the rotor at rest and also at speed.

Figure 5:
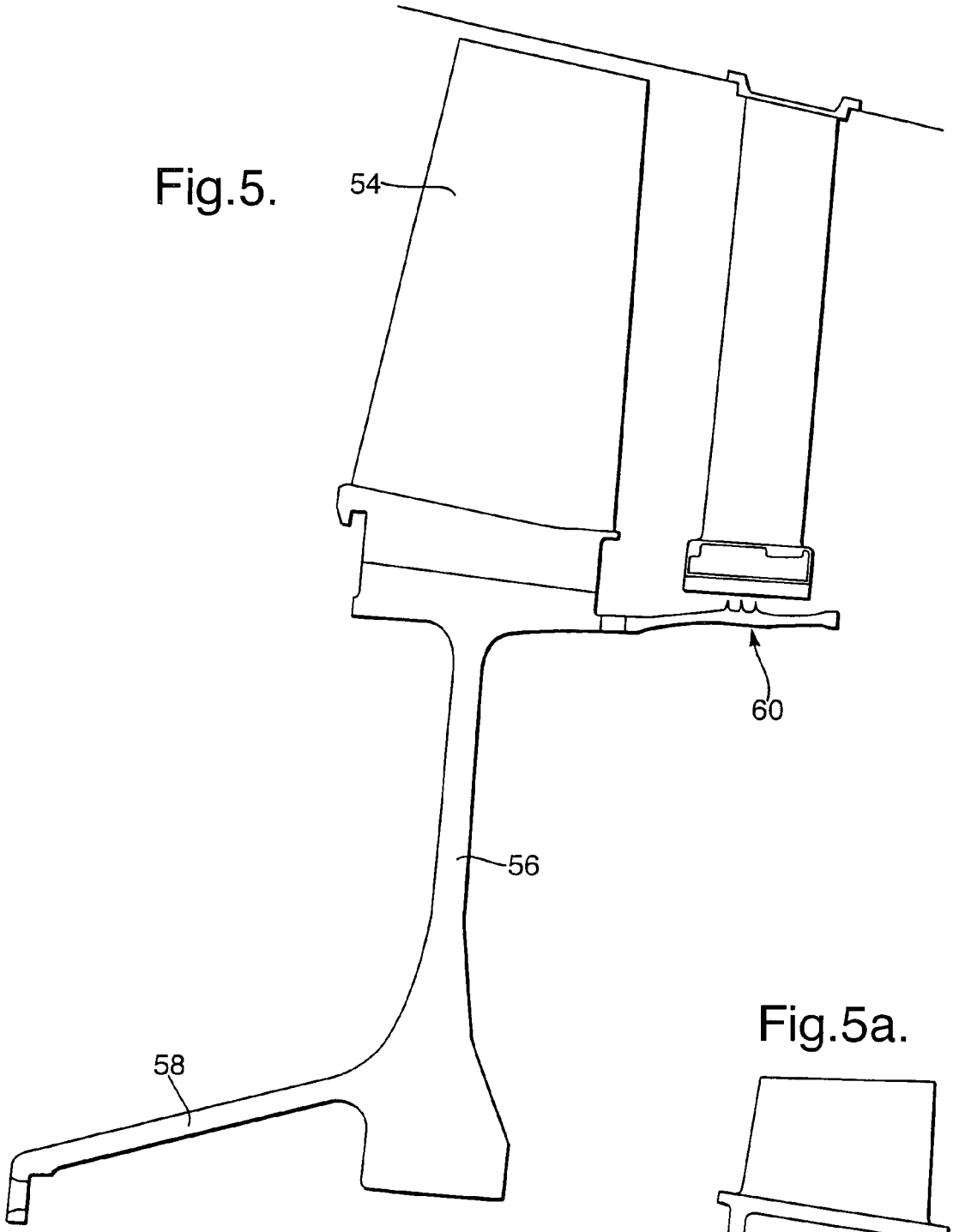
FIG. 5 is a diagrammatic side view of a labyrinth seal according to the invention.
Figure 5A:
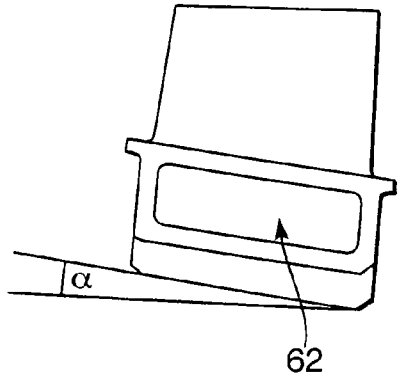
FIG. 5*a* is a detailed view of part of FIG. 5.

FIG. 5 shows a further single rotor blade 54 on a disc 56 with a drive arm 58. A labyrinth seal 60 is provided at the rear of the rotor arm 56 and the head 62 of the seal 60 is shown in more detail in FIG. 5*a* illustrating the angle α. The arrangement in FIG. 5 will work in a similar manner with the gap in the labyrinth seal 60 remaining substantially constant if the following equation is satisfied:

$$delX.\ \sin(\alpha)=delY.\ \cos(\alpha)$$

Where the delX and delY are taken at the labyrinth seal rather than at the rotor tip.

Figure 6:
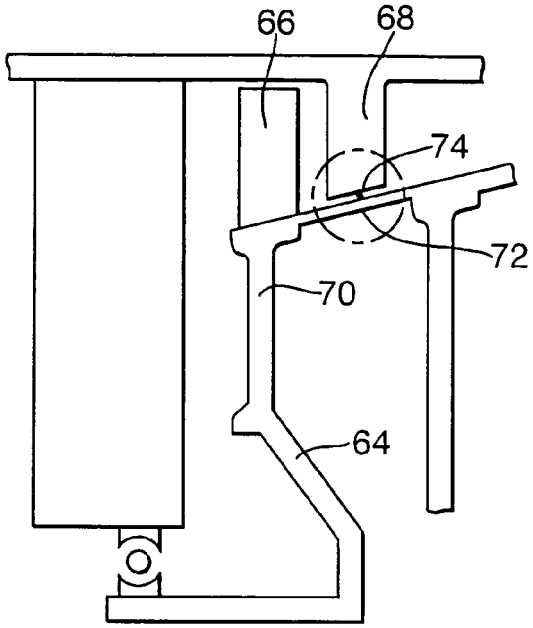
FIG. 6 is a diagrammatic view of a compressor cantilevered stator according to the invention.

FIG. 6 shows an arrangement with a drive arm 64, a rotor blade 66 and a stator 68 behind the blade 66. The rotor blade 66 is mounted on a drum 70, and a part 72 thereof extends rearwardly to provide an inclined gap 74 with the stator 68. The gap 74 is inclined downwardly forwards with the drive arm cranked forwards, such that rotation of the rotor 70 and hence drive arm 64 causes rearward movement to maintain the gap 74 substantially constant.

Figure 7:
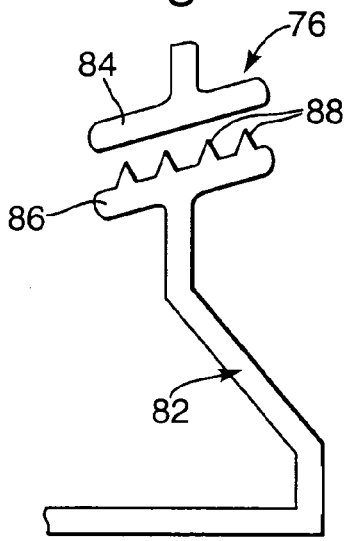
FIG. 7 is a diagrammatic side view through part of a stator seal according to the invention.

FIG. 7 shows a stator seal mounted on a drive arm 82 which is cranked in a forwards direction (left in the drawings). The seal 76 comprises upper and lower plates 84, 86 with a gap therebetween which points downwardly in a forwards direction (left in the drawings) direction. A plurality of projections 88 are provided on the plate 86 to enhance the sealing effect.

Figure 8:
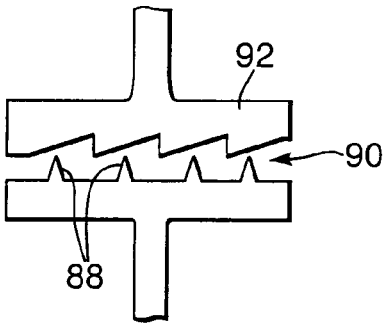
FIG. 8 is a diagrammatic side view of part of a modified arrangement similar to FIG. 7.

FIG. 8 shows part of a modified arrangement similar to FIG. 7 but where a saw tooth profile 90 is provided on an upper plate 92. The indentations in the tooth profile correspond to the projections 88 to enhance the sealing effect provided.

Figure 9:
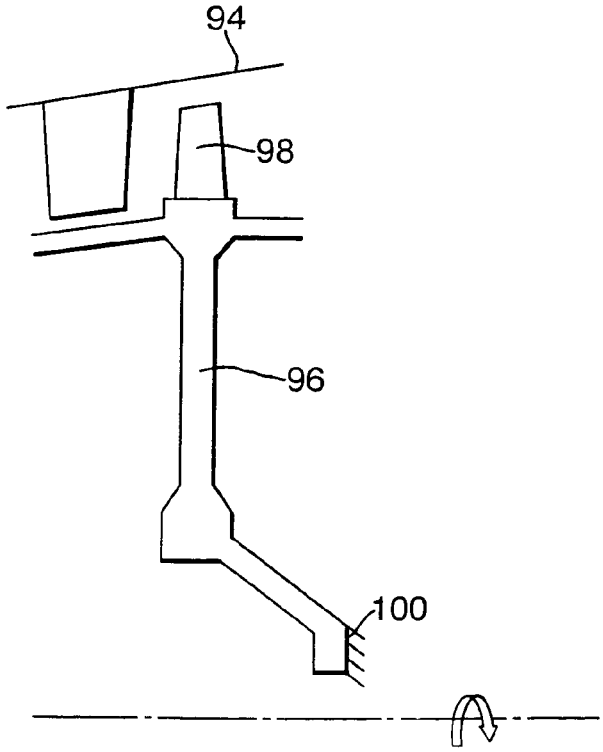
FIGS. 9 to 11 are each diagrammatic side views of part of respective alternative compressor configurations according to the invention.

FIG. 9 shows part of a compressor similar to that shown in FIG. 2 except that the casing 94 is inclined outwardly and therefore provides a rising hade angle. Therefore to provide a drive arm 96 which in use will move outwards and rearwards to provide a substantially constant tip clearance for the rotor blade 98, the arm 96 is forward facing relative to the mounting thereof at 100.

Figure 10:
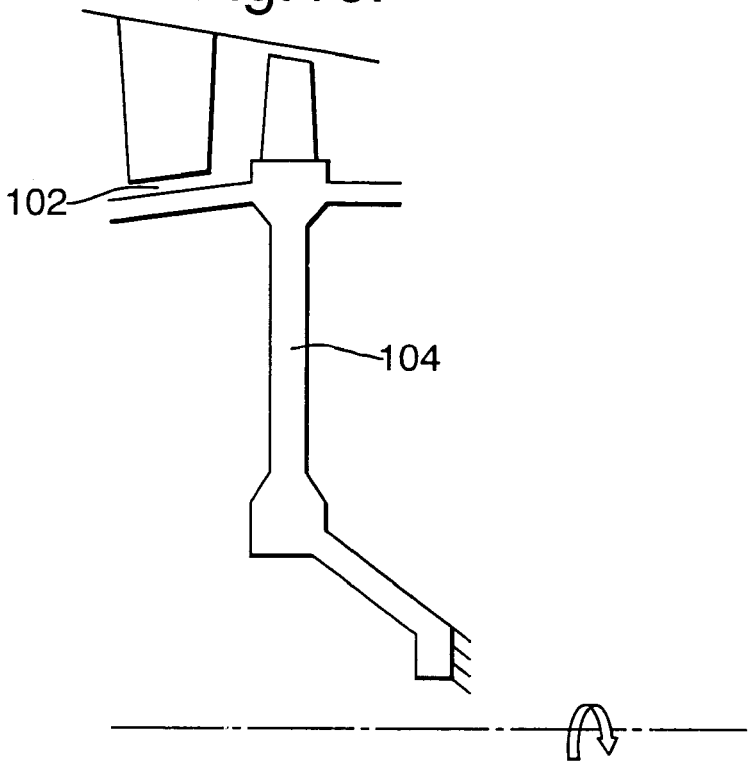
Figure 11:
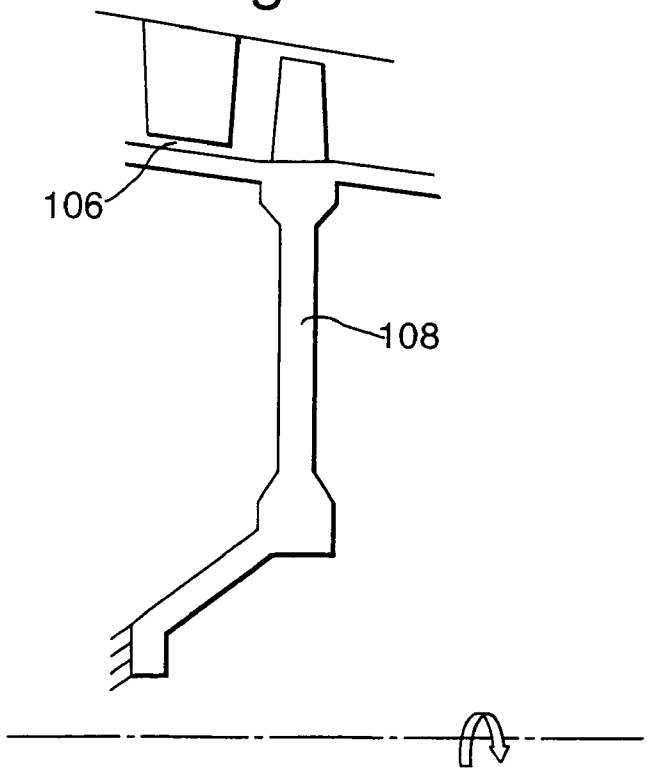

FIG. 10 illustrates a compressor arrangement with an inner wall tip clearance at 102 with a rising hade angle and therefore again a forward facing drive arm 104 is provided. FIG. 11 shows a similar inner wall tip clearance in a compressor at 106. However, in this instance there is a falling hade angle, and hence the drive arm 108 is rearward facing.

Figure 12:
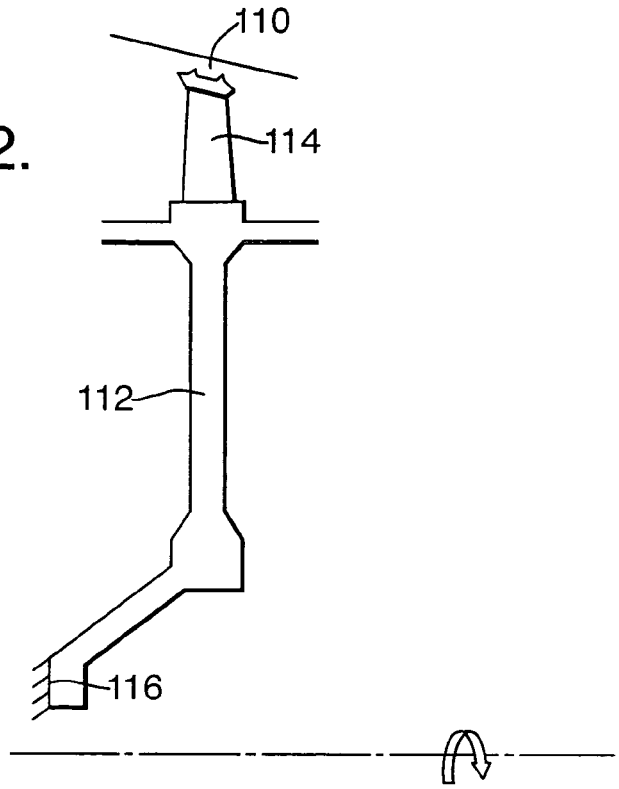
FIGS. 12 to 15 are each diagrammatic side views of parts of respective alternative turbine configurations according to the invention.
Figure 13:
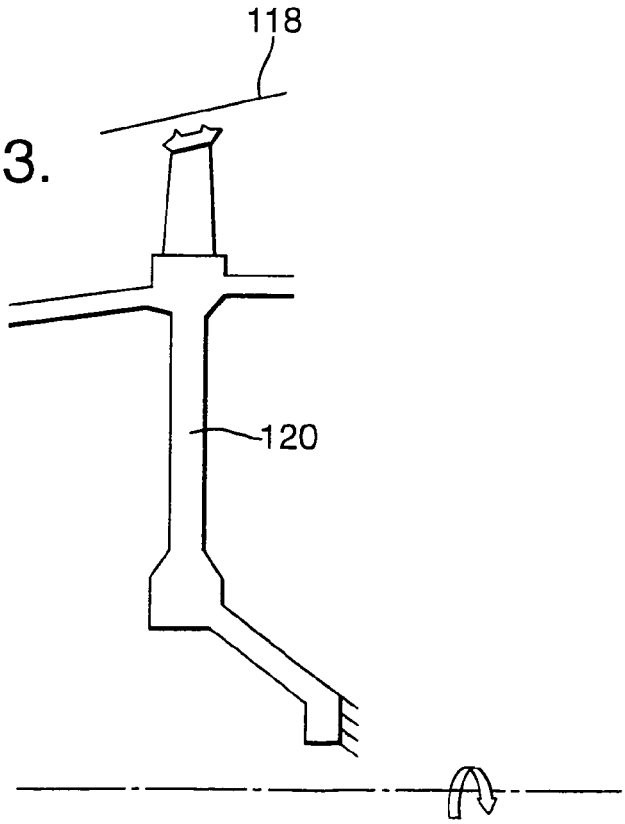

FIGS. 12 to 15 illustrate different possible arrangements with turbines. FIG. 12 shows providing tip clearance at 110 with a falling hade angle. In this instance the drive arm 112 is rearward facing such that during rotation the turbine blade 114 will move outwards and also forwards due to the moment produced by the centrifugal loads acting at the axial rearward offset mounting 116 of the drive arm 112. FIG. 13 shows a similar arrangement to FIG. 12 except that there is a rising hade angle of the casing 118 and therefore a forward facing drive arm 120 is provided.

Figure 14:
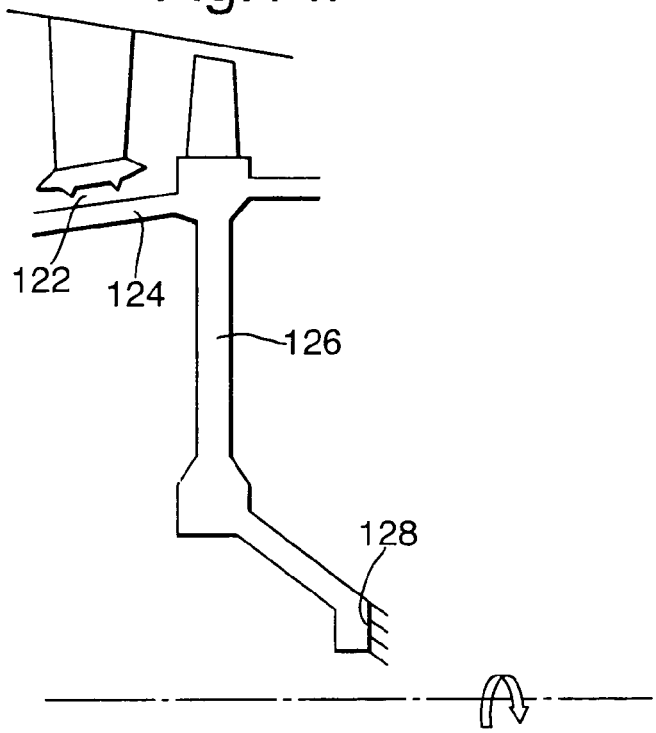
Figure 15:
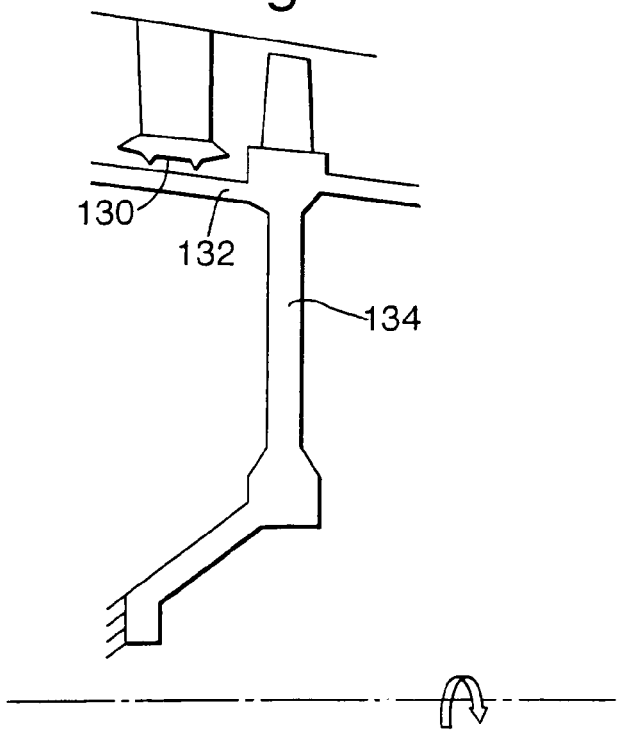

In FIG. 14 tip clearance is provided at 122 against an inner wall 124 with a rising hade angle. A forward facing drive arm 126 is provided so that the wall 124 will move outwards and also rearwards due to the moment produced by centrifugal loads acting in the axial forward offset mounting 128. FIG. 15 again shows tip clearance at 130 relative to an inner wall 132. In this instance there is a falling hade angle and therefore there is a rearward facing drive arm 134 to provide outwards and also forwards movement during use.

There are thus described various arrangements which provide for an optimum gap around a rotor in a compressor or a turbine, or in respective components in a labyrinth or other seal, which maintains the gap substantially constant irrespective of the speed of rotation. In contrast to prior arrangements using for example thermal effects, the present arrangement provides for instantaneous adjustment.

Various other modifications may also be made without departing from the scope of the invention.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A spacing arrangement for a gas turbine engine, the arrangement comprising a first rotatable member and a second non rotatable member with a gap defined between facing surfaces respectively on the first and second members, the gap being inclined relative to the rotational axis of the first member; characterised in that axial movement means are provided which automatically cause relative movement of a one of the first and second members in a direction to tend to increase the gap between the facing surfaces, in response to the rotational speed of the first member.

2. A spacing arrangement according to claim 1, characterised in that the axial movement means are arranged such that centrifugal forces caused by rotation of the first member cause the axial movement.

3. A spacing arrangement according to claim 2, characterised in that the axial movement means is in the form of a connecting member which connects the first member to a source of rotational movement.

4. A spacing arrangement according to claim 3, characterised in that the connecting member pivots or flexes upon rotational movement to cause the axial movement.

5. A spacing arrangement according to claim 1, characterised in that where there is a falling hade angle, the connecting member extends from the source of rotational movement, in part in a rearwards direction.

6. A spacing arrangement according to claim 1, characterised in that where there is a rising hade angle, the connecting member extends from the source of rotational movement, in part in a forwards direction.

7. A spacing arrangement according to claim 3, characterised in that a plurality of first members are connected to the connecting member.

8. A spacing arrangement according to claim 1, characterised in that the gap is inclined at an angle of between 3 and 30° relative to the rotational axis of the first member.

9. A spacing arrangement according to claim 1, characterised in that the first member flexes during rotational movement to cause some or all of the axial movement.

10. A spacing arrangement according to claim 1, characterised in that the arrangement is arranged to provide a substantially constant gap width at all rotational speeds.

11. A spacing arrangement according to claim 1, characterised in that the first member is a compressor blade, with the second member a compressor casing.

12. A compressor for a gas turbine engine, characterised in that the compressor comprises one or more spacing arrangements according to claim 1, provided between the compressor blades and the compressor casing.

13. A spacing arrangement according to claim 1, characterised in that the first member is a turbine blade and the second member a turbine casing.

14. A turbine, characterised in that the turbine incorporates a spacing arrangement according to claim 13.

15. A spacing arrangement according to claim 1, characterised in that the second member comprises a stator of a compressor or a turbine of a gas turbine engine, with the first member being part of the rotor.

16. A spacing arrangement according to claim 1, characterised in that the spacing arrangement is in the form of a labyrinth seal.

17. A spacing arrangement according to claim 16, characterised in that one of the facing surfaces is profiled, and the facing surfaces may have complimentary profiles.

18. A spacing arrangement according to claim 17, characterised in that one of the facing surfaces includes a plurality of projections.

19. A spacing arrangement according to claim 17, characterised in that one of the facing surfaces has a saw tooth profile.

* * * * *